US007717800B2

(12) United States Patent
Pyrce

(10) Patent No.: US 7,717,800 B2
(45) Date of Patent: May 18, 2010

(54) SWING WITH A RECLINE MECHANISM AND METHOD OF USING THE SAME

(75) Inventor: Philip R. Pyrce, Getzville, NY (US)

(73) Assignee: Mattel, Inc., El Segundo, CA (US)

( * ) Notice: Subject to any disclaimer, the term of this patent is extended or adjusted under 35 U.S.C. 154(b) by 560 days.

(21) Appl. No.: 11/737,876

(22) Filed: Apr. 20, 2007

(65) Prior Publication Data

US 2008/0258513 A1 Oct. 23, 2008

(51) Int. Cl.
*A63G 9/16* (2006.01)
*A63G 9/00* (2006.01)

(52) U.S. Cl. ..... 472/119; 472/118; 297/273; 5/105

(58) Field of Classification Search ..... 472/118–125; 297/273, 278, 279; 5/93.1, 93.2, 101, 105, 5/106

See application file for complete search history.

(56) References Cited

U.S. PATENT DOCUMENTS 3,806,117 A 4/1974 Foster
4,240,625 A * 12/1980 Meeker ..... 472/119
4,550,456 A 11/1985 Allen
4,805,902 A 2/1989 Casagrande
4,822,033 A * 4/1989 Kohus et al. ..... 472/119
4,940,229 A 7/1990 Foster
5,562,548 A 10/1996 Pinch et al.
5,694,655 A * 12/1997 Shepler et al. ..... 5/105
5,803,817 A 9/1998 Stern
6,343,994 B1 2/2002 Clarke
6,464,594 B1 10/2002 Canna et al.
6,572,189 B1 6/2003 Blaymore
6,629,727 B2 10/2003 Asbach et al.
6,634,038 B2 * 10/2003 Hsia ..... 5/95
6,908,397 B2 6/2005 Armbruster et al.
7,329,192 B2 * 2/2008 Gibree ..... 472/119
2004/0036335 A1 2/2004 Gentil
2004/0207235 A1 10/2004 Christensen et al.
2005/0189796 A1 9/2005 Gregorian
2005/0253432 A1 11/2005 Flanagan
2006/0128486 A1 6/2006 Tuckey
2006/0138828 A1 6/2006 Hartenstine et al.
2006/0194639 A1 8/2006 Greger et al.
2006/0211506 A1 9/2006 Kakuda
2006/0214486 A1 9/2006 Ransil et al.
2006/0252564 A1 11/2006 Bellows et al.
2006/0252566 A1 11/2006 Gibree
2006/0276253 A1 12/2006 Chen

OTHER PUBLICATIONS

"Fisher-Price L1962 Smart Stages 3-in-1 Rocker Swing" printout from http://dmart.stores.yahoo.net/fiprl1smst3r.html, 2 pages.

* cited by examiner

*Primary Examiner*—Kien T Nguyen
(74) *Attorney, Agent, or Firm*—Edell, Shapiro & Finnan LLC

(57) ABSTRACT

The present invention relates to an infant support structure, such as a swing for a child. In one embodiment, the child swing includes a recline mechanism that can be adjusted to change the recline angle of the seat in which a child is positioned.

20 Claims, 12 Drawing Sheets

SWING WITH A RECLINE MECHANISM AND METHOD OF USING THE SAME

FIELD OF THE INVENTION

The present invention relates to an infant support structure, such as a swing for a child. In one embodiment, the child swing includes a seat and a recline mechanism that can be adjusted to change the orientation or recline angle of the seat.

BACKGROUND OF THE INVENTION

Various types of swings for children are known. Usually, a swing includes a frame, one or more hanger arms that are pivotally coupled to the frame, and a seat that is attached to the hanger arms. Some swings include a drive mechanism which moves the hanger arms and the seat in a reciprocating manner.

Some child swings include a recline mechanism that can be adjusted to change the inclination of a portion of the seat relative to another portion of the seat. For example, a seat back can be pivotally mounted relative to a seat bottom so that the angle of the seat back with respect to the seat bottom can be adjusted. In that arrangement, the seat back can be disposed in various positions, such as an upright position, a fully reclined position, and/or an intermediate position between the upright position and the fully reclined position.

Conventional child swings do not provide recline mechanisms that are easy to use. Therefore, a need exists for an improved recline mechanism for a swing for a child.

SUMMARY OF THE INVENTION

The present invention relates to a swing with a seat and a recline mechanism that can be manipulated to adjust at least a portion of the seat. In one embodiment, the seat includes a seat frame with a first portion and a second portion, and the first portion is movable relative to the second portion. The recline mechanism is configured to move the first portion relative to the second portion and thereby change the recline angle of the seat frame.

BRIEF DESCRIPTION OF THE DRAWINGS

Like reference numerals have been used to identify like elements throughout this disclosure.

DETAILED DESCRIPTION OF THE INVENTION

The infant support structure according to the present invention is a swing with a seat and a recline mechanism. The recline mechanism can be used to adjust the orientation or recline angle of the seat. In one embodiment, the swing includes a frame and the seat is movably mounted to the frame so that it can be oriented in different directions for different swinging motions. In another embodiment, the seat can be removably coupled to the frame so that the seat can be detached from the frame and carried to a different location.

The terms "rods," "tubes," "tubular members," and "bars" may be used interchangeably to refer to elongate members that can be used with the present invention. Similarly, the terms "recline," "recline angle," "inclination," and "orientation" may be used interchangeably to refer to the angle at which a portion of the seat frame is disposed. Changing that angle may be referred to as changing the inclination, the orientation, and/or the recline angle of a portion of the seat frame. Also, the recline mechanism of the present invention may be referred to as the adjustment mechanism.

Figure 1:
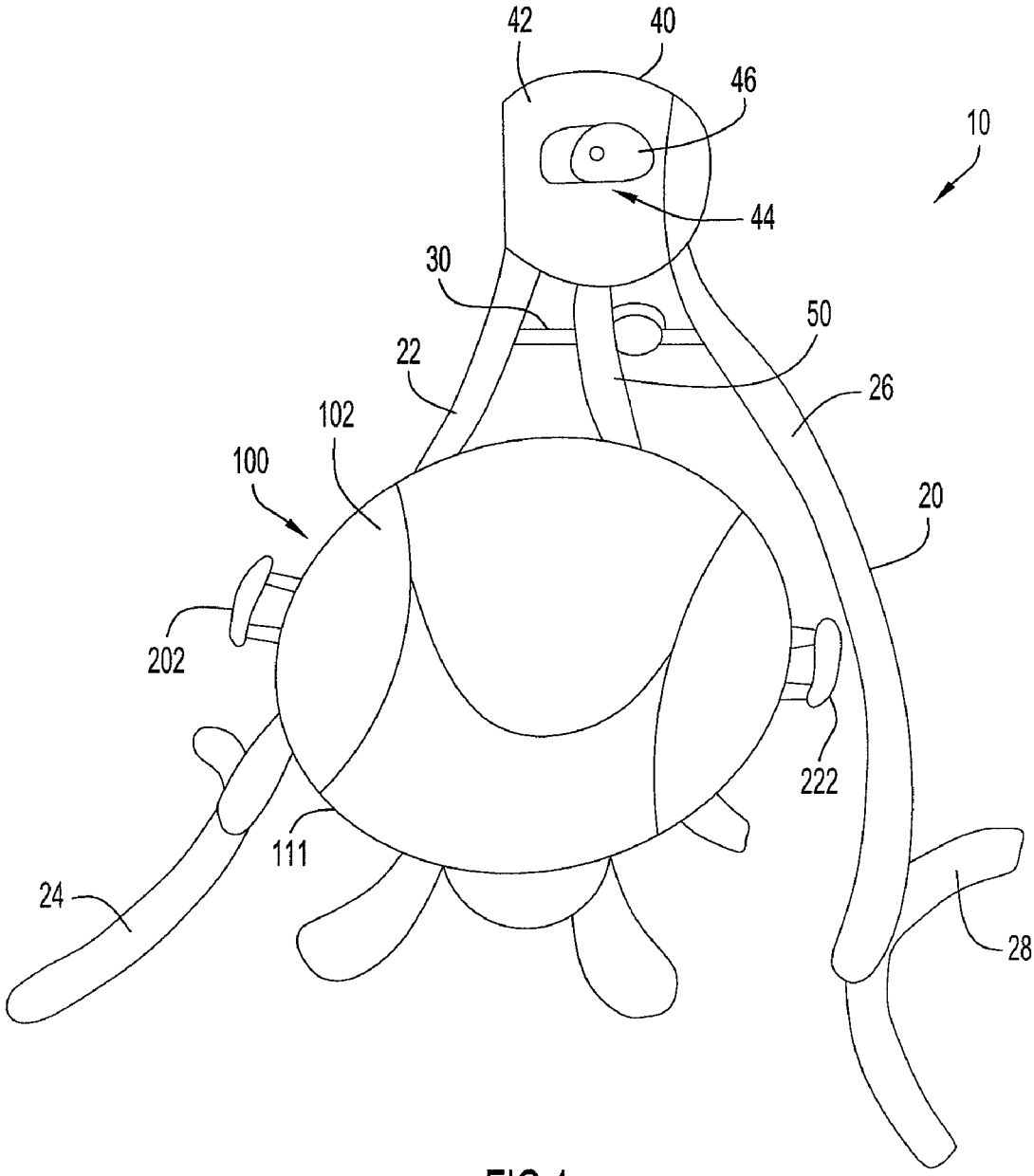
FIG. 1 illustrates a perspective view of an embodiment of a child swing according to the present invention.

An embodiment of an infant support structure is illustrated in FIG. 1. In this embodiment, the infant support structure 10 is a swing that includes a frame 20, a hanger arm 50 movably coupled to the frame 20, and a seat 100 that is coupled to the hanger arm 50. The frame 20 supports the hanger arm 50 so that the seat 100 is suspended from the frame 20 (and above the supporting surface 101). The swing 10 includes a drive mechanism that moves the hanger arm 50 and, as a result, the seat 100 as well.

As illustrated, the frame 20 includes legs 22 and 26 that are coupled to bases 24 and 28, respectively, using a conventional connector or fastener, such as a bolt or a screw. The bases 24 and 28 are configured to support the frame 20 on the supporting surface 101, such as a floor. A cross-member 30 extends between legs 22 and 26 to provide additional support to the frame 20. The cross-member 30 can have any shape or configuration provided that it adds side-to-side or lateral support to the frame 20.

A housing 40 is mounted on the top ends of legs 22 and 26. Contained within the housing 40 is a drive mechanism (not shown) that is coupled to the hanger arm 50. The drive mechanism is configured to impart reciprocating movement to the hanger arm 50. In this embodiment, the housing 40 has a front surface 42 with a control panel or portion 44. The control portion 44 allows a user to control the swinging motion of the seat 100 and the electronic features of the swing 10, such as music, sound effects, and output volume level. Referring to FIG. 1, the control portion 44 can include a large button 46 which can be manipulated, such as by rotation, to control the speed of the swing 10. The swing 10 can be operated any one of several speeds.

Figure 2:
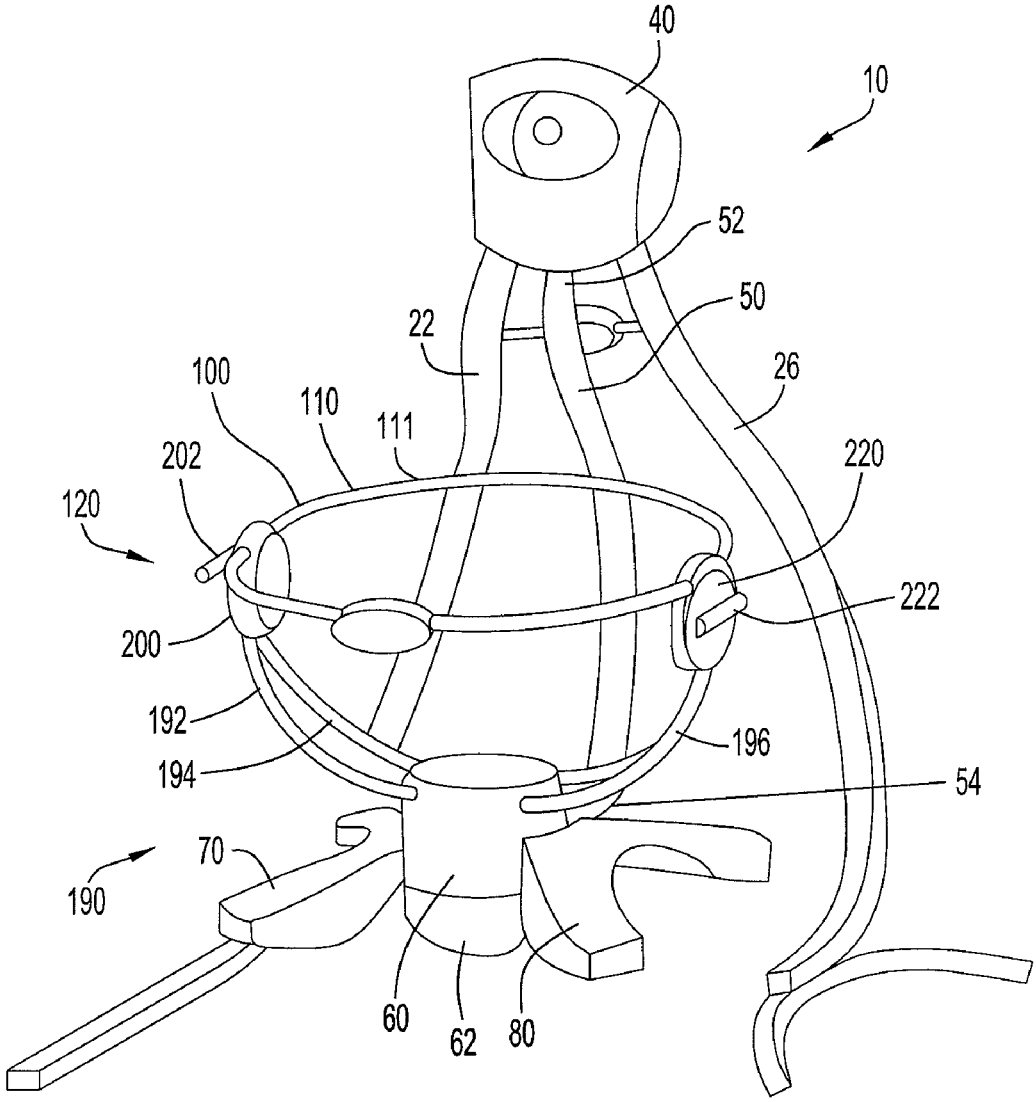
FIG. 2 illustrates a perspective view of some of the components of the child swing illustrated in FIG. 1.

Referring to FIGS. 1 and 2, the seat 100 includes a seat frame 110 and softgoods 102 that are coupled to the seat frame 110. In one embodiment, the softgoods 102 can be removably coupleable to the seat frame 110 so that it can be easily removed for cleaning and washing. The softgoods may also be referred to as a fabric cover. The seat 100 also includes a restraint assembly (not shown) that is used to retain a child in the seat 100.

The seat frame 110 includes handles 202 and 222 on opposite sides of the seat frame 110. The seat 100 is removably coupled to the hanger arm 50 and can be transported by a caregiver using the handles 202 and 222. The seat 100 can be coupled to the hanger arm 50 in the orientation illustrated in FIG. 1 for motion in a front-to-back swing motion. Alternatively, the seat 100 can be rotated relative to the hanger arm 50 approximately 90° from that illustrated in FIG. 1 so that the seat 100 moves in a side-to-side cradle-like motion.

Referring to FIG. 2, the seat frame 110 of the swing 10 is illustrated in detail. As shown, the hanger arm 50 includes an upper end 52 that is supported by the housing 40 and a lower end 54 that is coupled to a seat base mounting portion 62. The seat frame 110 includes a seat base 60 that is rotatably coupled to the mounting portion 62. Coupled to opposite sides of the seat base 60 are legs or supports 70 and 80. When the seat base 60 is detached from the mounting portion 62, the legs 70 and 80 enable a caregiver to place the seat 100 on a supporting surface.

The seat frame 110 includes an upper portion 120 and a lower portion 190. The upper portion 120 is formed by a generally circular tube or bar arrangement that supports the softgoods 102 of the seat 100. The upper portion 120 is formed in the shape of a substantially circular ring. The upper portion 120 and lower portion 190 collectively define the shape of the receptacle formed by the seat 100 to contain or support a child. In particular, the upper portion 120 defines the outer perimeter 111 of the seat 100 or the infant receiving area in the seat 100.

The seat frame 110 includes a pair of hubs or housings 200 and 220 on either side of the seat frame 110. Handles 202 and 222 are coupled to housings 200 and 220, respectively. In this embodiment, the handles 202 and 222 are coupled to the housings 200 and 220 using any conventional fasteners. The upper portion 120 is pivotally mounted to the housings 200 and 220 as will be described in detail below.

The lower portion 190 includes several tubes or bars that are coupled to the upper portion 120 and to the seat base 60. As shown in FIG. 2, bars 192 and 194 extend from housing 200 to the seat base 60. Similarly, bars 196 and 198 extend from housing 220 to the seat base 60. In this embodiment, bars 192, 194, 196, and 198 have generally curved configurations. In alternative embodiments, the quantity and configuration of the bars of the lower portion 190 of the seat frame 110 can vary.

The seat 100 includes a recline mechanism that can be manipulated to adjust the orientation of the upper portion 120 of the seat frame 110. In particular, the recline mechanism is configured to enable a caregiver to change the recline angle of the upper portion 120 relative to the lower portion 190 of the seat frame 110. The upper portion 120 can be disposed in multiple orientations. The recline mechanism is operable whether the seat 100 is mounted to the swing frame 20 or detached therefrom. For reference, the upper portion 120 of the seat frame 110 can be referred to as a movable portion and the lower portion 190 of the seat frame 110 can be referred to as a fixed portion.

Figure 3:
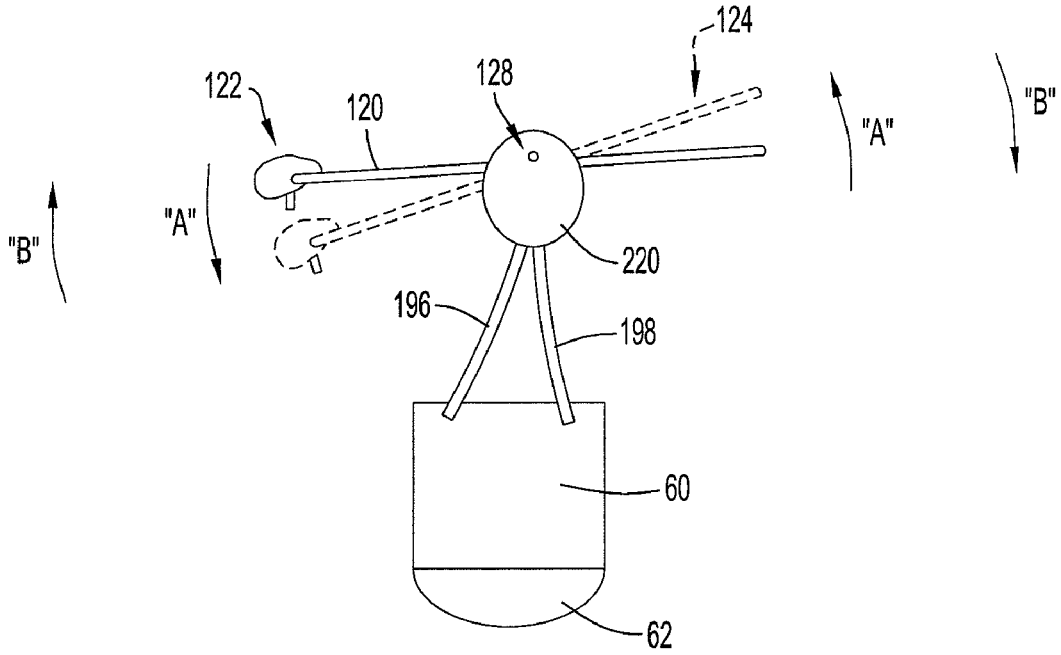
FIG. 3 illustrates a side view of some of the components of the seat frame of the child swing illustrated in FIG. 2.

Referring to FIG. 3, two configurations of the upper portion 120 of the seat frame 110 are illustrated. Only some components of the swing 10 are shown in FIG. 3 for ease of reference. The upper portion 120 of the seat 100 is pivotally coupled to the housings 200 and 220. The upper portion 120 is mounted for movement about pivot axis 128, which extends through housing 220. The upper portion 120 can be placed in a first position or orientation 122 in which it is substantially horizontal. This position can be referred to as a recline or reclined position. The upper portion 120 can be moved about pivot axis 128 along the direction of arrows "A" to a second orientation 124. In the second position 124, the front of the upper portion 120 is lower than the rear of the upper portion 120 and a child in the seat 100 is in a more upright or inclined position. When desired, the upper portion 120 can be moved along the direction of arrows "B" from the second position or orientation 124 to the first position or orientation 122.

Figure 4:
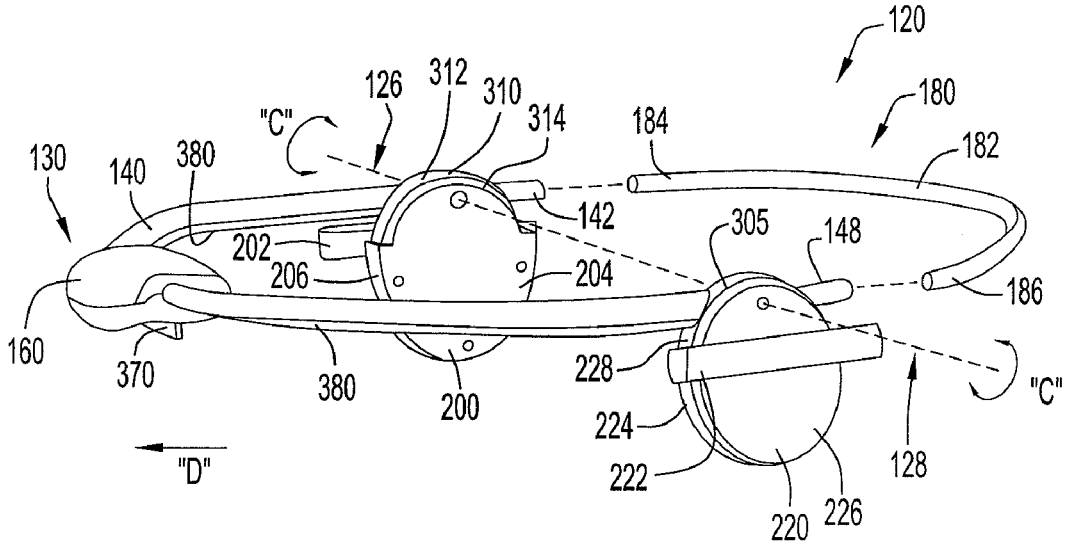
FIG. 4 illustrates a perspective view of some of the components of the seat frame of the child swing illustrated in FIG. 2.

An embodiment of a portion of the seat is illustrated in FIG. 4. In this embodiment, the upper portion 120 includes a front portion 130 and a rear portion 180. The front portion 130 includes a bar 140 that has a coupler 160 mounted thereon. The bar 140 extends from end 142 to end 148 and is pivotally mounted to the housings 200 and 220. The rear portion 180 includes a bar 182 that is detachably coupled to the front portion 130. In particular, ends 184 and 186 of bar 182 can be coupled to ends 142 and 148, respectively, of bar 140. Ends 184 and 186 can be sized and configured so that they can be inserted into the openings of ends 142 and 148 in a telescopic arrangement. In one implementation, the ends of the bars can be coupled together using a spring-biased button member. In another implementation, a screw, a rivet, or other fastener can be used to connect the ends together, such as by being inserted through hole 146 in bar 140 (see FIG. 5) and a corresponding hole on bar 182. The front portion 130 and the rear portion 180 collectively form the upper portion 120 of the seat 100. When the front portion 130 and rear portion 180 are coupled together, the upper portion 120 of the seat 100 can be pivoted along the directions of arrows "C" about pivot axes 126 and 128. In this embodiment, the range from the recline position to the incline position is approximately 12 to 15 degrees. In other embodiments, the range between the positions can be either less or greater than that range.

As shown in FIG. 4, housing 200 includes an inner portion 204 and an outer portion 206 that are coupled together using any conventional fasteners or connectors. The inner portion 204 and the outer portion 206 collectively define an opening 208 near the upper end of the housing 200. Similarly, housing 220 includes an inner portion 224 and an outer portion 226 that are coupled together and collectively define an opening 228.

The seat 100 includes an adjustment or recline mechanism with several components disposed within each of the housings 200 and 220. Referring to FIG. 4, housing 200 includes a coupler 310 that is rotatably mounted therein. In this embodiment, the coupler 310 is formed from two parts 312 and 314 that are coupled together to capture a portion of the bar 140 therebetween. The coupler 310 is mounted for rotation about axis 126 (along the direction of arrow "C") and the coupler 310 and bar 140 rotate together. Similarly, housing 220 includes a coupler 305 rotatably mounted therein. Coupler 305 receives another portion of bar 140 and rotates about axis 128 along the direction of arrow "C." The particular features of the couplers and the movement of the components of the seat frame 110 are described in greater detail below.

Figure 5:
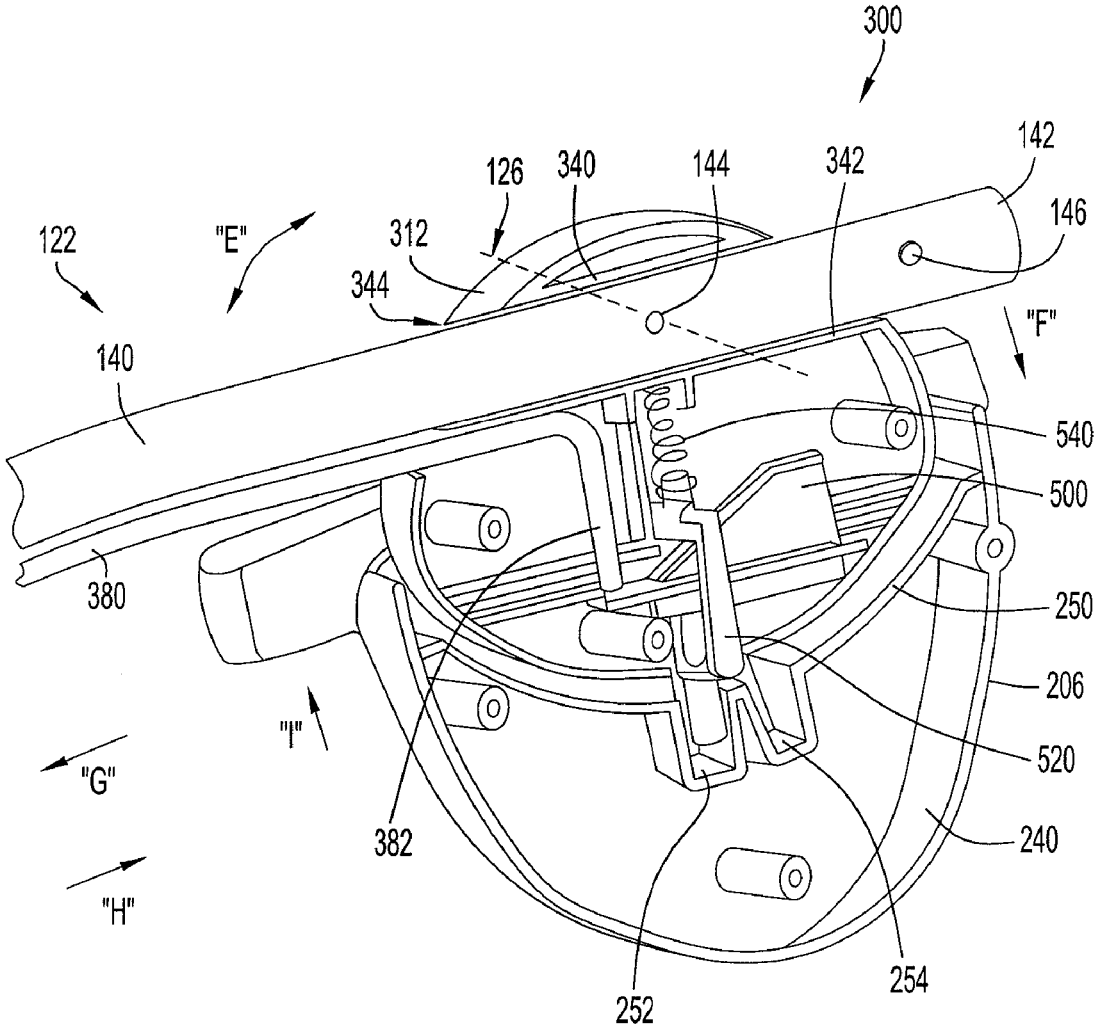
FIG. 5 illustrates a close-up perspective view of some components of the recline mechanism of the child swing illustrated in FIG. 2, shown in a deployed configuration.

Referring to FIGS. 4 and 5, an embodiment of a recline mechanism according to the present invention is illustrated. In FIG. 5, some of the components of the housing 200, the coupler 310, and the recline mechanism 300 are illustrated. While only the portion of the recline mechanism associated with housing 200 is described below for simplicity, the portion of the recline mechanism associated with housing 220 has similar components, arrangement and operation.

Figure 11:
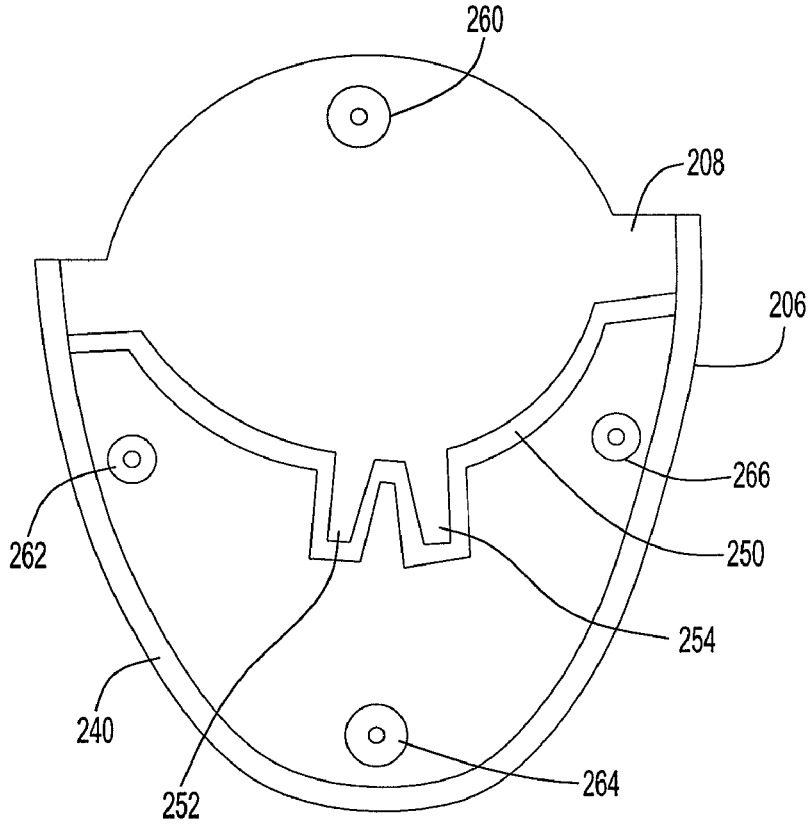
FIG. 11 illustrates a side view of the inner surface of an embodiment of a housing according to the present invention.

Referring to FIG. 5, the outer part 206 of housing 200 is shown with the inner part 204 removed so that the interior of the housing 200 can be shown. In this embodiment, the outer part 206 and the inner part 204 of the housing 200 are mirror-images of each other. The outer part 206 of the housing 200 includes a side wall 240 that extends around most of its perimeter. An inner wall 250 extends from one side to the other side of the housing 200. The inner wall 250 defines two receptacles 252 and 254, which correspond to and define different orientations of the upper portion 120 of the seat frame 110. In alternative embodiments, the inner wall 250 may include more than two receptacles, which would allow the seat upper portion 120 to be placed in additional positions or orientations. The receptacles 252 and 254 can be referred to alternatively as openings or detents. Additional structural features of the housing 200 are illustrated in FIG. 11 and described in detail below.

Figure 12:
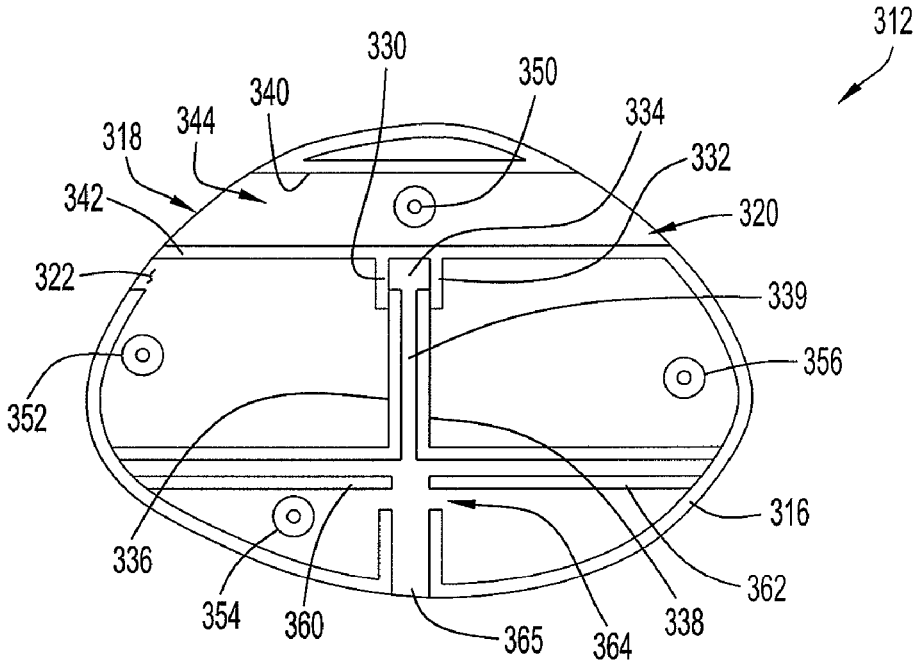
FIG. 12 illustrates a side view of the inner surface of an embodiment of a coupler according to the present invention.
Figure 13:
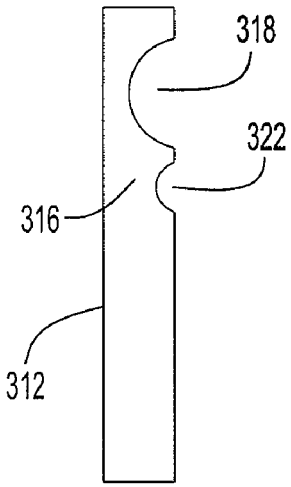
FIG. 13 illustrates a front view of the coupler illustrated in FIG. 12.
Figure 14:
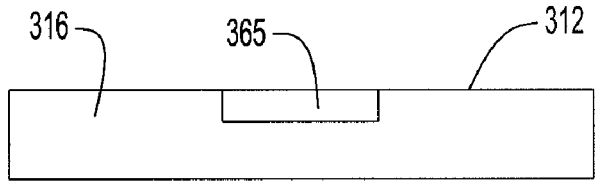
FIG. 14 illustrates a bottom view of the coupler illustrated in FIG. 12.

Referring to FIG. 5, the outerpart 312 of coupler 310 is illustrated. The innerpart 314 of the coupler 310 is not illustrated so that the internal components of the coupler 310 can be shown. The coupler outer part 312 includes walls 340 and 342 that define a channel 344 therebetween. The channel 344 is configured to receive a portion of the bar 140 of the seat upper portion 120. The bar 140 is connected to the coupler 310 by a fastener that is inserted through hole 144 in the bar 140. That fastener also passes through and is coupled to the housing 200 and to the inner and outer parts of the coupler 310. Accordingly, the coupler 310 and the bar 140 are pivotally mounted to the housing 200 about the fastener in hole 144, which defines pivot axis 126. The coupler 310 and bar 140 are movable along the directions of arrow "E" (see FIG. 5). Additional structural features of the coupler 310 are illustrated in FIGS. 12-14 and described below.

Figure 8:
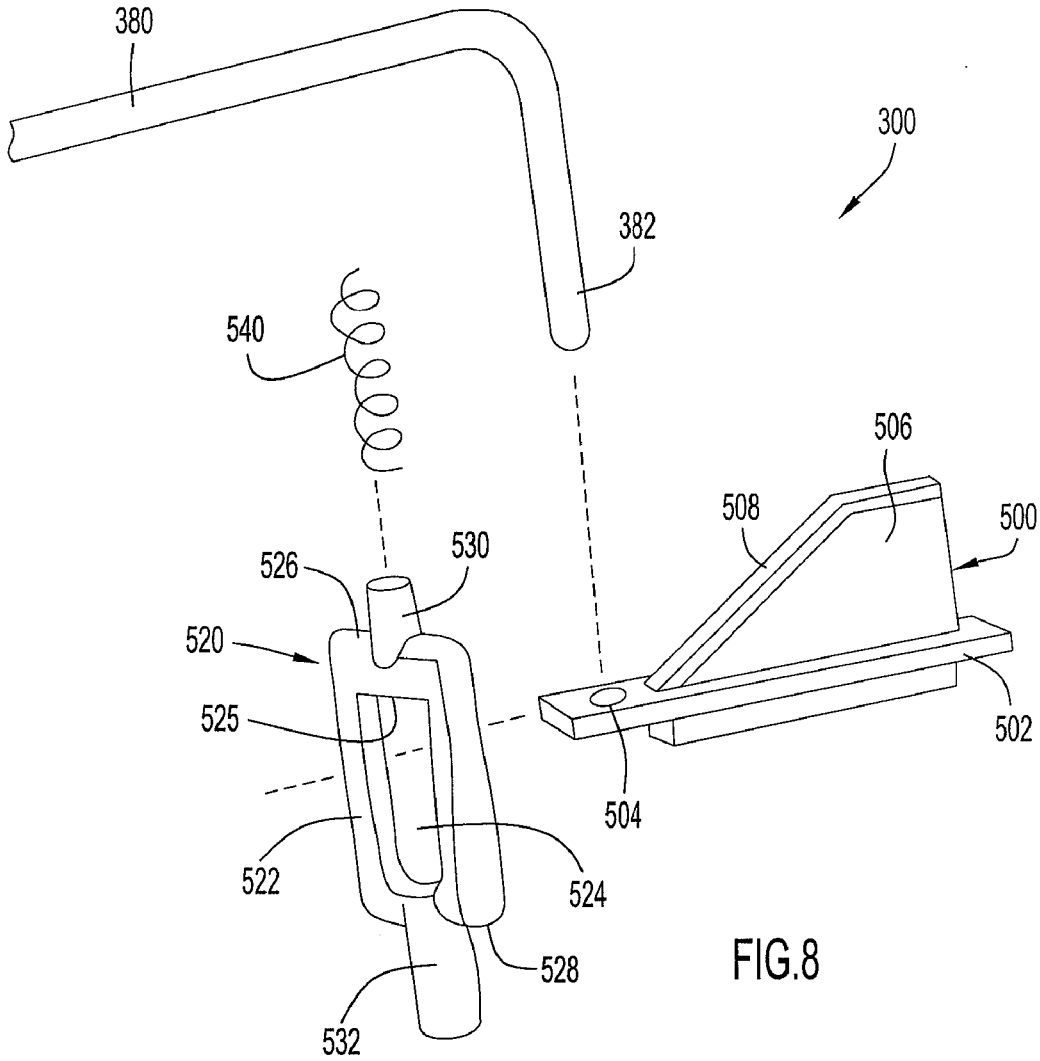
FIG. 8 illustrates an exploded perspective view of some of the components of the recline mechanism illustrated in FIG. 5.
Figure 17:
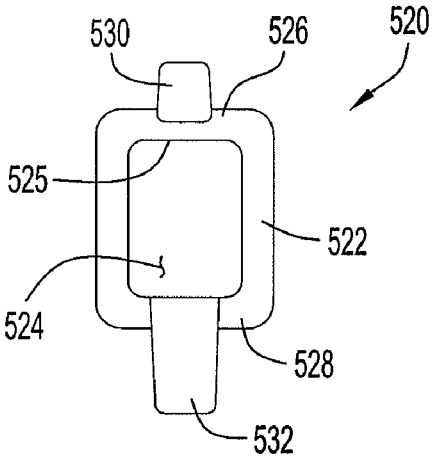
FIG. 17 illustrates a front view of an embodiment of a locking member according to the present invention.
Figure 18:
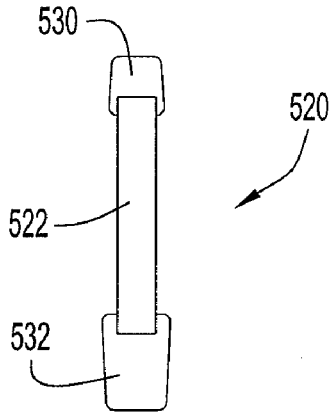
FIG. 18 illustrates a side view of the locking member illustrated in FIG. 17.

The recline mechanism 300 includes a locking member 520. The locking member 520 prevents movement of the seat upper portion 120 relative to the housings 200 and 220. As illustrated in FIGS. 5 and 8, the locking member 520 includes a body 522 with an opening 524 and an extension 532 that can be selectively located in receptacle 252 or in receptacle 254. The locking member 520 is movable between a locked position in which it engages a receptacle and an unlocked position in which it is disengaged from a receptacle. When the extension 532 of locking member 520 is engaged with either receptacle 252 or 254, coupler 310 and bar 140 are prevented from rotating relative to housing 200. Referring to FIG. 5, extension 532 is illustrated as being engaged with receptacle 252. Additional structural features of the locking member 520 are illustrated in FIGS. 17 and 18 and described below.

The recline mechanism 300 also includes a cam member 500. The cam member 500 engages and moves the locking member 520. As illustrated in FIGS. 5 and 8, the cam member 500 includes a base 502 with an upper portion 506 that has a cam surface 508. Part of the cam member 500 is inserted through the opening 524 of the locking member 520. When the cam member 500 moves, the cam surface 508 engages the inner surface 525 of the locking member 520 that defines a portion of the opening 524.

The recline mechanism 300 also includes a biasing member 540. The biasing member 540 is placed between part of the coupler 310 and the locking member 520 to apply a force to the locking member 520. As illustrated in FIG. 5, the biasing member 540 applies a force along the direction of arrow "F" to the locking member 520. When the locking member 520 moves along the direction of arrow "F," the extension 532 engages either receptacle 252 or receptacle 254. In this embodiment, the biasing member 540 is a coil spring. In other embodiments, the biasing member 540 can be a different type of spring or any other element that can apply a force onto the locking member 520.

As illustrated in FIGS. 4, 5, and 8, the recline mechanism 300 includes an actuator 370 and an elongate member 380 that is movable. The elongate member 380 has the same contour and configuration as bar 140. As shown in FIG. 4, the elongate member 380 passes through the coupler 160 and extends to the couplers 305 and 310. The actuator 370 is movably mounted in the coupler 160 and located so a user can pull on the actuator 370 along the direction of arrow "D" (see FIG. 4). The actuator 370 and coupler 160 are located on the front portion of the upper portion 120 of the seat 100. Accordingly, a user can adjust the inclination of the seat 100 at the front of the seat 100 using one hand to move the actuator from an un-actuated position to an actuated position and to support the upper portion 120 of the seat frame 110 at the same time.

Figure 6:
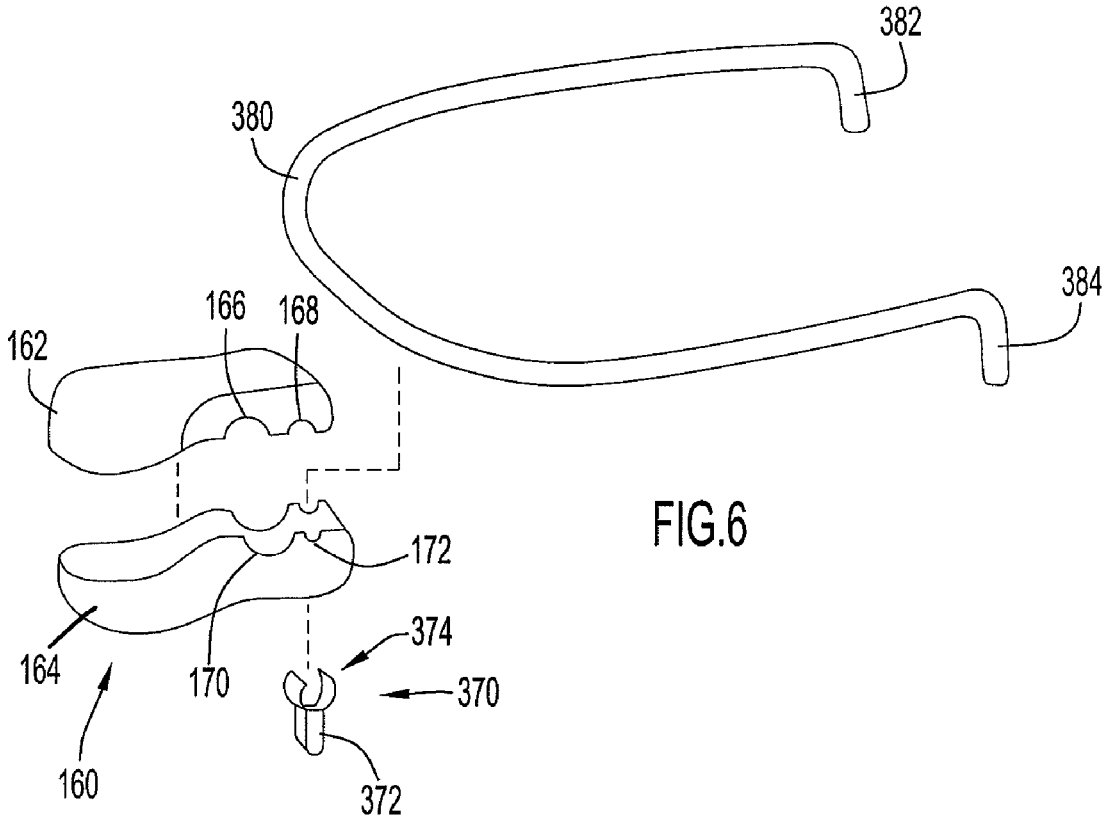
FIG. 6 illustrates an exploded perspective view of some of the components of the recline mechanism of the child swing illustrated in FIG. 2.

Referring to FIG. 6, the elongate member 380 is a tubular structure, such as a rod, that has bent end portions 382 and 384. In this embodiment, coupler 160 is formed of portions 162 and 164 that are connected together using conventional fasteners. The portions 162 and 164 include recesses 166 and 170, respectively, that form an opening to receive a portion of bar 140 of the upper portion 120 of the seat frame 110 (not shown in FIG. 6). The portions 162 and 164 also include slots 168 and 172 that form an opening through which a portion of the rod 380 is inserted. The slots 168 and 172 are configured to allow movement of the rod 380 relative to the remainder of the coupler 160. The elongate member 380 can be a rod, a tube, a wire, a cable, or other similar structure.

Figure 7:
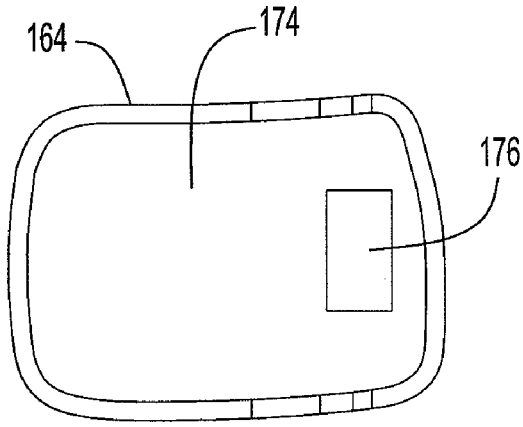
FIG. 7 illustrates a lower portion of the coupler illustrated in FIG. 6.

Referring to FIG. 7, the coupler portion 164 includes a lower surface 174 with an opening 176 formed therein. As shown in FIG. 6, the actuator 370 has a body 372 with a connector portion 374 that is configured to be coupled to the rod 380. The actuator 370 is configured to extend through the opening 176 to a position in which it is accessible to the user (see FIG. 4). The opening 176 is configured so that the actuator 370 can be moved by a user some distance between an un-actuated position and an actuated position to actuate the recline mechanism. In different embodiments, the size or configuration of the opening 176 and the coupler 160 can vary. In this embodiment, the coupler 160 and the actuator 370 can be formed of molded plastic materials and the rod formed of metal. A biasing member 373, such as a steel coil spring, can be located between the actuator 370 and part of the coupler 160 to apply a force along the direction of action (arrow "D"). The biasing member 373 moves the actuator 370 back to its rest position after actuation. In other embodiments, the biasing member 373 can be any type of spring or element that can provide a force on the actuator 370.

Referring to FIG. 5, the arrangement of the components of the recline mechanism 300 is described in greater detail. End 382 of the rod 380 is coupled to the cam member 500 so that movement of the rod 380 causes movement of the cam member 500. In this embodiment, the distal end 382 of the rod 380 is configured to be inserted into an opening 504 formed in the cam member 500 (see FIG. 8). When the rod 380 is pulled along the direction of arrow "G" in FIG. 5, the cam member 500 moves in the same direction. When the rod 380 moves along the direction of arrow "H," the cam member 500 moves in the same direction.

When the cam member 500 moves along the direction of arrow "G," the cam surface 508 engages and pushes surface 525 of locking member 520 upwardly along the direction of arrow "I." If the locking member 520 moves upwardly a sufficient distance, the extension 532 disengages from the receptacles 252 and 254 and the coupler 310 and bar 140 can rotate about axis 126. When the user releases the actuator 370, the biasing member 540 applies force to the locking member 520 to move it along the direction of arrow "F" and the cam member 500 moves along the direction of arrow "H."

Figure 9:
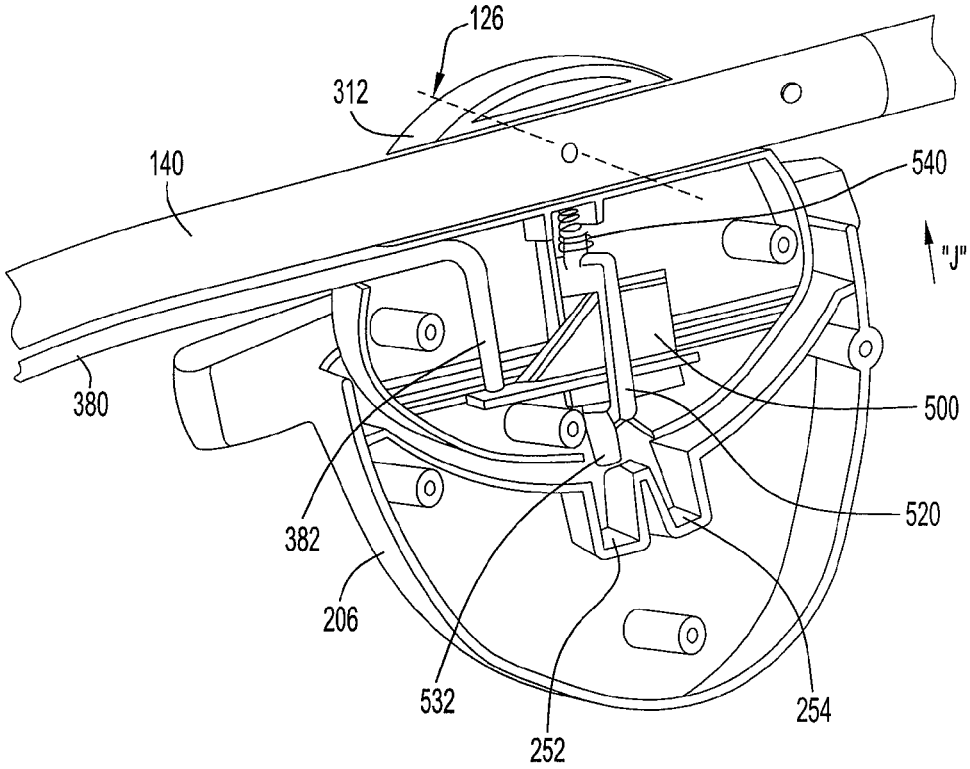
FIG. 9 illustrates a close-up perspective view of the recline mechanism components illustrated in FIG. 5, shown in an intermediate configuration.
Figure 10:
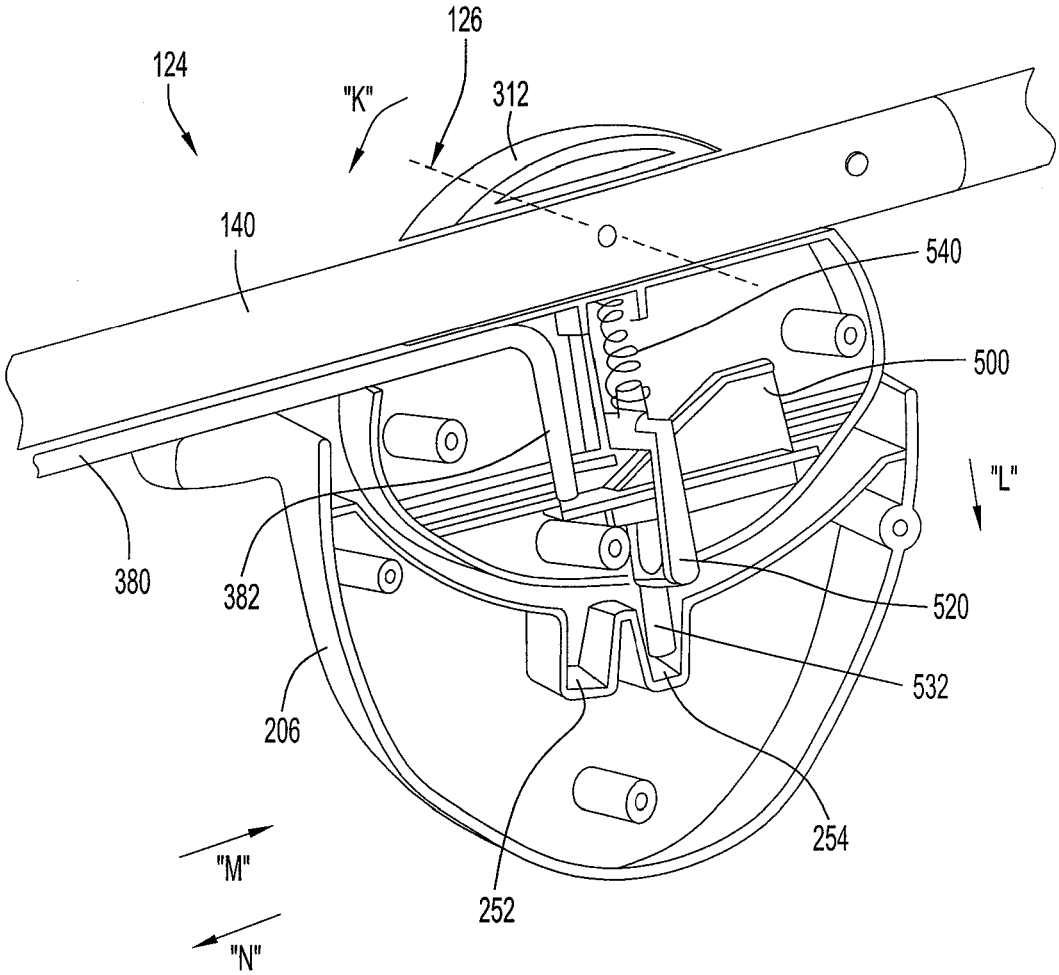
FIG. 10 illustrates a close-up perspective view of the recline mechanism components illustrated in FIG. 5, shown in another deployed configuration.

Referring to FIGS. 5, 9 and 10, the operation of the recline mechanism 300 is described. A first position or orientation of the seat upper portion 120 is illustrated in FIG. 5. In this orientation, the extension 532 of the locking member 520 is engaged with the receptacle 252. To change the inclination of the seat 100, the user pulls on the actuator 370 along the direction of arrow "G," thereby moving rod 380 and the cam member 500 in the same direction. The rod 380 is pulled with a sufficient force to overcome the force applied by the biasing member 540 on the locking member 520. When the rod 382 and the cam member 500 move, the cam surface 508 engages the locking member 520 and forces the locking member 520 upwardly against the biasing member 540 (see arrow "I" in FIG. 5).

As illustrated in FIG. 9, when the cam member 500 moves into the opening 524 of the locking member 520, the locking member 520 moves upwardly along the direction of arrow "J" and the biasing member 540 is compressed. In this position, the extension 532 of the locking member 520 disengages from the receptacle 252. At this point, the coupler 310 and the bar 140 can rotate about axis 126.

Referring to FIG. 10, the coupler 310 and the bar 140 can be rotated about axis 126 along the direction of arrow "K." When the coupler 310 and bar 140 are in their second or inclined position 124, the tension applied to rod 380 is released. At this point, the biasing member 540 forces the locking member 520 downwardly along the direction of arrow "L." The locking member 520 slides along the cam surface 508 of the cam member 500, which, along with elongate member 380, moves along the direction of arrow "M." When the locking member 520 continues to move downwardly, the extension 532 engages receptacle 254. The engagement of the extension 532 with the receptacle 254 prevents the coupler 310 and bar 140 from rotating and retains the seat frame upper portion 120 in an inclined or more upright position.

To change the angle of inclination from an inclined position (see FIG. 10) to reclined position (see FIG. 5), a force is applied on the actuator 370 to move it along the direction of arrow "N" in FIG. 10. Such movement causes the cam member 500 to move in the same direction and the locking member 520 to move upwardly. When the extension 532 disengages from receptacle 254, the coupler 310 can be rotated about axis 126 to the intermediate position shown in FIG. 9 and to the reclined position shown in FIG. 5. When the desired position is reached, the actuator 370 can be released and the locking member extension 532 engages receptacle 252.

An embodiment of a portion of a housing is illustrated in detail in FIG. 11. In this embodiment, the housing portion is an outer portion 206 that can be coupled to an inner portion 204 to form housing 200. As previously described, the housing outer portion 206 includes a side wall 240 and an inner wall 250 that has receptacles 252 and 254 formed therein. The angles of orientation of the receptacles 252 and 254 determine the different angles of inclination of the upper portion 120 of the seat 100. In various embodiments, the angles of orientation of the receptacles can vary. While only two receptacles are illustrated, different embodiments of the housing according to the invention can have more than two receptacles. The additional receptacles provide extra settings and orientations (or angles of inclination) from which the user can choose to dispose the seat frame. While receptacles 252 and 254 are illustrated as being cavities formed in the inner wall 250, in other embodiments, the inner wall can be continuous and the receptacles can be holes formed in the inner wall. Also, the size and configuration of the receptacles 252 and 254 can vary so long as they can receive a portion of the locking member 520.

The housing outer portion 206 can be coupled to a mirror-image housing inner portion using conventional fasteners, such as screws. The fasteners can be inserted through mounts 260, 262, 264, and 266 and a part of the housing inner portion 204. The fastener that is inserted through mount 260 extends through bar 140 of the seat upper portion 120 and establishes the pivot axis 126. While in one embodiment, the housing can be formed of molded plastic, in other embodiments different materials, including metal, can be used.

An embodiment of part of a coupler according to the present invention is illustrated in FIGS. 12-14. As previously described, each coupler is formed by two portions that can be coupled together using conventional fasteners. In FIG. 12, the inner portion of coupler 310 is removed so that the inner surface of the outer portion 312 can be illustrated and described. Conventional fasteners can be inserted through mounts 350, 352, 354, and 356 to attach the coupler portions together. The fastener that is inserted through mount 350 is the same fastener that passes through bar 140 and through the housing 200 as previously described.

Coupler portion 312 includes an outer wall 316 that extends around a portion of its perimeter. As illustrated in FIGS. 12 and 13, openings 318 and 320 are formed in the outer wall 316 and are configured to receive a portion of bar 140. The coupler portion 312 includes walls 340 and 342 that define a channel 344 that extends from opening 318 to opening 320. The outer wall 316 also includes a smaller opening 322 formed therein through which the elongate member 380 of the recline mechanism 300 can be inserted.

Referring to FIG. 12, there are several other walls formed on the inner surface of the coupler portion 312. Walls 336 and 338 define a channel 339 therebetween. The channel 339 is configured to receive a portion of the locking member 520 and guide its movement. Near one end of the channel 339 are walls 330 and 332 that form a receptacle 334 into which the biasing member 540 is located. Channel 339 is aligned with an opening 365 that is formed in the bottom surface of the coupler portion 312. The opening 365 is configured to allow the extension 532 of the locking member 520 to extend therethrough.

The coupler portion 312 also includes walls 360 and 362 that form a surface or pathway 364 along which the cam member 500 moves back and forth. As illustrated in FIG. 12, the paths of movement of the cam member 500 and the locking member 520 intersect.

Figure 15:
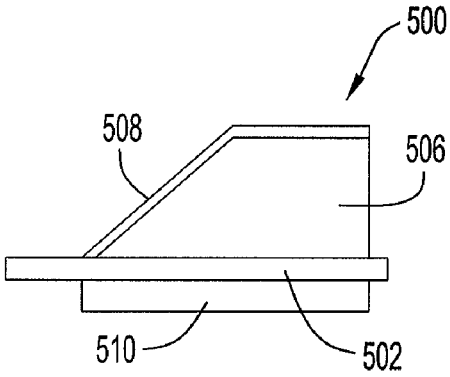
FIG. 15 illustrates a side view of an embodiment of a cam member according to the present invention.
Figure 16:
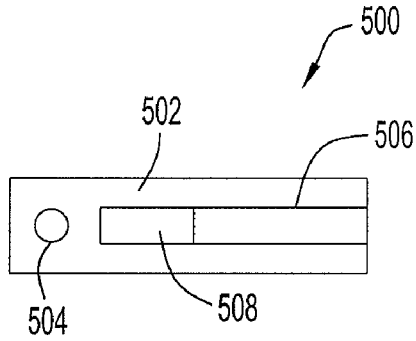
FIG. 16 illustrates a top view of the cam member illustrated in FIG. 15.

An embodiment of a cam member according to the present invention is illustrated in FIGS. 15 and 16. In this embodiment, the cam member 500 includes a base 502 with an upper portion 506 and a lower portion 510. The base 502 has an opening 504 formed therein, the function of which has been previously described. The upper portion 506 includes a cam surface 508 that extends upwardly from the base 502. In alternative embodiments, the angle and length of the cam surface 508 can vary provided that sufficient force can be applied to the locking member 520 to move it during operation of the recline mechanism.

An embodiment of a locking member according to the present invention is illustrated in FIGS. 17 and 18. In this embodiment, the locking member 520 includes a body 522 with an inner surface 525 that defines an opening 524 in the body 522. In alternative embodiments, the size and shape of the opening 524 can vary.

Coupled to an end 526 of the body 522 is a protrusion or extension 530. Extension 530 is configured to accommodate a portion of the biasing member 540 and thereby maintain contact between the biasing member 540 and the locking member 520. While in this embodiment the extension 530 is formed as an integral part of the body 522, in other embodiments, the extension 530 can be formed separately and subsequently coupled to the body 522.

Coupled to the other end 528 of the body 522 is a protrusion or extension 532. Extension 532 is configured to engage one of the receptacles 252 or 254 formed in the housing 200. Similar to extension 530, extension 532 can be formed as an integral part of the body 522 or alternatively, can be formed separately and subsequently coupled to the body 522.

In the illustrated embodiment, the cam members and the locking members are formed of a molded plastic material. In other embodiments, different materials, such as metal, can be used. Additionally, the recline mechanism and methods of using the recline mechanism described herein for the present invention can be applied to other infant receiving or support devices (such as cribs, bassinets, bouncers, etc.). The recline mechanism is applicable to any infant support device to which a portion of a seat or support frame can be pivotally mounted.

In other embodiments, the structures that are used to control the movements of the components of the adjustment or recline mechanism can vary. In other embodiments, the inner and outer portions of the coupler can be different from each other.

While the invention has been described in detail and with reference to specific embodiments thereof, it will be apparent to one skilled in the art that various changes and modifications can be made therein without departing from the spirit and scope thereof. For example, it is to be understood that terms such as "top," "bottom," "front," "rear," "side," "height," "length," "width," "upper," "lower," "interior," "exterior," "inner," "outer," and the like as may be used herein, merely describe points of reference and do not limit the present invention to any particular orientation or configuration. Thus, it is intended that the present invention covers the modifications and variations of this invention provided they come within the scope of the appended claims and their equivalents.

What is claimed is:

1. An infant support structure, comprising:

a frame; and a seat, the seat being supported by the frame, the seat including:

a seat frame having a first portion and a second portion, the seat frame including a first housing and a second housing disposed on opposite sides of the seat frame, the first housing and the second housing being configured to movably support the first portion of the seat frame relative to the second portion of the seat frame, the first portion of the seat frame having a substantially circular configuration and a front portion and a rear portion; and a recline mechanism, the recline mechanism being configured to recline the first portion of the seat frame in a position relative to the second portion of the seat frame, the recline mechanism also being configured to retain the first portion of the seat frame alternatively in a reclined position and in an inclined position, the recline mechanism including an actuator, the actuator being disposed proximate to the front portion of the first portion of the seat frame.

2. The infant support structure of claim 1, wherein the recline mechanism includes a locking member that is selectively disposable in multiple positions relative to the first housing, each of the positions of the locking member corresponding to one of the reclined position and the inclined position of the first portion of the seat frame.

3. The infant support structure of claim 2, wherein actuator is located between the first housing and the second housing and movable between an un-actuated position and an actuated position, the actuator being operatively coupled to the locking member such that movement of the actuator from the un-actuated position to the actuated position moves the locking member from a locked position to an unlocked position.

4. The infant support structure of claim 3, wherein the recline mechanism includes an elongate member extending between the first housing and the second housing, the elongate member being movable relative to the seat frame, and the actuator is connected to the elongate member such that movement of the actuator causes movement of the elongate member.

5. The infant support structure of claim 4, wherein the elongate member is in the form of a rod or a tube.

6. The infant support structure of claim 4, wherein the actuator is provided on a front portion of the seat frame, and the elongate member extends forwardly of the first housing and the second housing.

7. The infant support structure of claim 6, wherein the actuator is arranged relative to the seat frame such that the actuator can be actuated and the seat frame can be supported during recline with only one hand.

8. The infant support structure of claim 6, wherein the first portion of the seat frame comprises a bar, and the elongate member has substantially the same contour as the bar of the first portion of the seat frame.

9. The infant support structure of claim 3, wherein the actuator is provided on a front portion of the seat frame.

10. The infant support structure of claim 1, wherein the recline mechanism includes a first locking member associated with the first housing and a second locking member associated with the second housing, and wherein the actuator is operatively coupled to the first locking member and to the second locking member such that movement of the actuator from the un-actuated position to the actuated position moves each of the first locking member and the second locking member from its locked position to its unlocked position.

11. The infant support structure of claim 10, wherein the recline mechanism includes a first biasing member and a second biasing member, the first biasing member being disposed to bias the first locking member into its locked position, and the second biasing member being disposed to bias the second locking member into its locked position.

12. The infant support structure of claim 11, wherein when the actuator is moved from the un-actuated position to the actuated position, the first biasing member and the second biasing member are compressed by the first locking member and the second locking member, respectively.

13. The infant support structure of claim 10, wherein each of the first housing and the second housing includes receptacles formed therein, and the first locking member is configured to selectively engage one of the receptacles in the first housing and the second locking member is configured to selectively engage one of the receptacles in the second housing.

14. The infant support structure of claim 13, wherein the first locking member is biased into engagement with a receptacle of the first housing in its locked position, and the second locking member is biased into engagement with a receptacle of the second housing in its locked position.

15. The infant support structure of claim 1, wherein the first portion of the seat frame is substantially ring-shaped and is pivotally mounted to the first housing and the second housing.

16. The infant support structure of claim 1, wherein the first portion of the seat frame is an upper portion and the second portion of the seat frame is a lower portion, and the seat includes a fabric cover that is suspended from the upper portion and covers the lower portion.

17. A seat configured to be suspended from a frame of an infant support structure, the seat comprising:

a seat frame, the seat frame including a movable portion and a fixed portion, the movable portion being configured to move relative to the fixed portion, the seat frame including a first housing and a second housing disposed on opposite sides of the seat frame, the movable portion being pivotally mounted to the first housing and to the second housing and adjustable between a reclined position and an inclined position; and a recline mechanism, the recline mechanism being operatively coupled to the movable portion of the seat frame and being configured to adjust the recline of the movable portion of the seat frame relative to the fixed portion of the seat frame, the recline mechanism including:

a first locking member associated with the first housing, the first locking member being selectively disposable in a locked position and in an unlocked position;

a second locking member associated with the second housing, the second locking member being selectively disposable in its own locked position and in its own unlocked position; and an actuator operatively coupled to the first locking member and to the second locking member, the actuator being configured to move the first locking member and the second locking member from their locked positions to their unlocked positions simultaneously, the actuator being disposed on the movable portion of the seat frame.

18. The seat of claim 17, wherein the movable portion of the seat frame defines the perimeter of the infant receiving area of the seat.

19. An infant support structure comprising:

a frame;

an arm, the arm being movably mounted to the frame;

a seat, the seat including a seat frame being supported by the arm, the seat frame including a lower portion and an upper portion that is substantially circular and defines the perimeter of the seat, the upper portion being pivotally mounted to the lower portion; and a recline mechanism, the recline mechanism being configured to recline the upper portion of the seat frame relative to the lower portion of the seat frame.

20. The infant support structure of claim 19, wherein the recline mechanism includes an actuator that is movable between an un-actuated position and an actuated position, the actuator being coupled to at least one locking member such that movement of the actuator from the un-actuated position to the actuated position moves the at least one locking member from a locked position to an unlocked position.

* * * * *

US007717800C1

(12) EX PARTE REEXAMINATION CERTIFICATE (10231st)

United States Patent
Pyrce

(10) Number: US 7,717,800 C1
(45) Certificate Issued: Jul. 24, 2014

(54) SWING WITH A RECLINE MECHANISM AND METHOD OF USING THE SAME

(75) Inventor: Philip R. Pyrce, Getzville, NY (US)

(73) Assignee: Mattel, Inc., El Segundo, CA (US)

Reexamination Request:
No. 90/012,956, Aug. 21, 2013

Reexamination Certificate for:

| | |
|---|---|
| Patent No.: | **7,717,800** |
| Issued: | **May 18, 2010** |
| Appl. No.: | **11/737,876** |
| Filed: | **Apr. 20, 2007** |

(51) Int. Cl.
*A63G 9/16* (2006.01)
*A63G 9/00* (2006.01)

(52) U.S. Cl.
USPC ..... 472/119; 472/118; 297/273; 5/105

(58) Field of Classification Search
None
See application file for complete search history.

(56) References Cited

To view the complete listing of prior art documents cited during the proceeding for Reexamination Control Number 90/012,956, please refer to the USPTO's public Patent Application Information Retrieval (PAIR) system under the Display References tab.

*Primary Examiner* — Russell Stormer

(57) ABSTRACT

The present invention relates to an infant support structure, such as a swing for a child. In one embodiment, the child swing includes a recline mechanism that can be adjusted to change the recline angle of the seat in which a child is positioned.

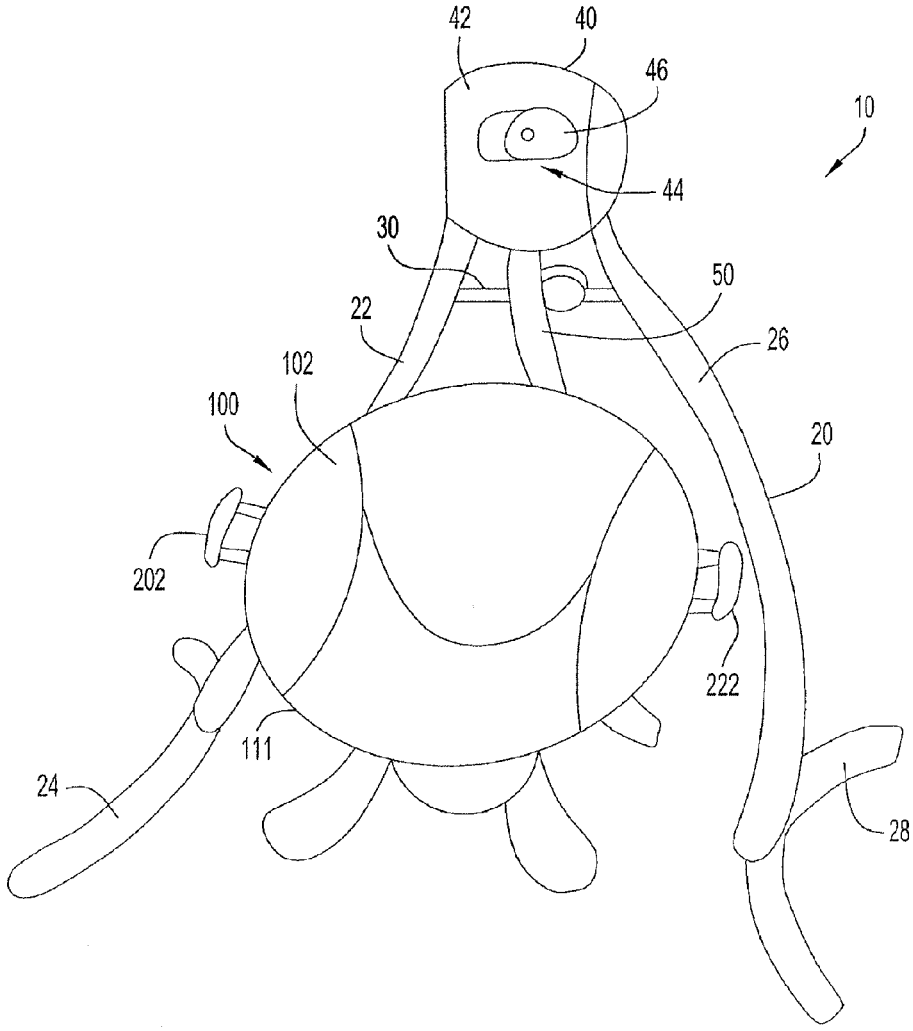

EX PARTE REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

Claim 18 is cancelled.

Claims 1, 3, 17 and 19 are determined to be patentable as amended.

Claims 2, 4-16 and 20, dependent on an amended claim, are determined to be patentable.

1. An infant support structure, comprising:

a frame; and a seat *including a receiving area for the infant*, the seat being supported by the frame, the seat including:

a seat frame having a first portion and a second portion, the seat frame including a first housing and a second housing disposed on opposite sides of the seat frame, the first housing and the second housing being configured to movably support the first portion of the seat frame relative to the second portion of the seat frame, the first portion of the seat frame having a substantially circular configuration and a front portion and a rear portion, *the first portion of the seat frame defining a perimeter that entirely surrounds the receiving area for the infant*; and a recline mechanism, the recline mechanism being configured to recline the first portion of the seat frame in a position relative to the second portion of the seat frame, the recline mechanism also being configured to retain the first portion of the seat frame alternatively in a reclined position and in an inclined position, *wherein the seat frame is operable for use supporting an infant in both the reclined and inclined positions,* the recline mechanism including an actuator, the actuator being disposed proximate to the front portion of the first portion of the seat frame.

3. The infant support structure of claim 2, wherein *the* actuator is located between the first housing and the second housing and movable between an un-actuated position and an actuated position, the actuator being operatively coupled to the locking member such that movement of the actuator from the un-actuated position to the actuated position moves the locking member from a locked position to an unlocked position.

17. A seat configured to be suspended from a frame of an infant support structure, the seat *including a receiving area for an infant, the seat* comprising:

a seat frame, the seat frame including a movable portion and a fixed portion, *the movable portion defining a perimeter that entirely surrounds the receiving area for the infant,* the movable portion being configured to move relative to the fixed portion, the seat frame including a first housing and a second housing disposed on opposite sides of the seat frame, the movable portion being pivotally mounted to the first housing and to the second housing and adjustable between a reclined position and an inclined position; and a recline mechanism, the recline mechanism being operatively coupled to the movable portion of the seat frame and being configured to adjust the recline of the movable portion of the seat frame relative to the fixed portion of the seat frame, *wherein the seat is maintained operable for use supporting an infant in the seat before and after adjusting the recline of the movable portion relative to the fixed portion,* the recline mechanism including:

a first locking member associated with the first housing, the first locking member being selectively disposable in a locked position and in an unlocked position;

a second locking member associated with the second housing, the second locking member being selectively disposable in its own locked position and in its own unlocked position; and an actuator operatively coupled to the first locking member and to the second locking member, the actuator being configured to move the first locking member and the second locking member from their locked positions to their unlocked positions simultaneously, the actuator being disposed on the movable portion of the seat frame.

19. An infant support structure comprising:

a frame;

an arm, the arm being movably mounted to the frame;

a seat *including a receiving area for an infant*, the seat including a seat frame being supported by the arm, the seat frame including a lower portion and an upper portion [that is], *the upper portion being* substantially circular and [defines the perimeter of the seat] *defining a perimeter that entirely surrounds the receiving area for the infant*, the upper portion being pivotally mounted to the lower portion; and a recline mechanism, the recline mechanism being configured to recline the upper portion of the seat frame relative to the lower portion of the seat frame, *wherein the seat is maintained operable for use supporting an infant before and after the recline of the upper portion relative to the lower portion*.

* * * * *